United States Patent [19]

Picken

[11] Patent Number: 4,934,971

[45] Date of Patent: Jun. 19, 1990

[54] SWIM FIN

[76] Inventor: James B. Picken, E. 11703 Buckeye, Spokane, Wash. 99206

[21] Appl. No.: 265,398

[22] Filed: Oct. 31, 1988

[51] Int. Cl.[5] ..... A63B 31/08

[52] U.S. Cl. ..... 441/64; 440/15

[58] Field of Search ..... 441/60, 61, 62, 63, 441/64; 440/14, 15

[56] References Cited

U.S. PATENT DOCUMENTS

| | | | |
|---|---|---|---|
| 183,045 | 10/1876 | Dunlop | D21/239 |
| D.193,455 | 8/1962 | Lassonde | D21/239 |
| 802,306 | 5/1905 | McKittrick | D21/239 |
| 1,062,587 | 5/1913 | Goersch | D21/239 |
| 2,729,832 | 1/1956 | Schmitz | 441/64 |
| 3,521,312 | 7/1970 | Ganev | 9/309 |
| 3,665,535 | 5/1972 | Picken | 9/304 |
| 4,209,866 | 7/1980 | Loeffler | 441/64 |
| 4,541,810 | 9/1985 | Wenzel | 441/64 |
| 4,657,515 | 4/1987 | Ciccotelli | 441/64 |
| 4,689,029 | 8/1987 | Ciccotelli | 441/64 |
| 4,781,637 | 11/1988 | Caires | 441/64 |

FOREIGN PATENT DOCUMENTS

| | | | |
|---|---|---|---|
| 1190346 | 10/1959 | France . | |
| 1245395 | 9/1960 | France | 441/64 |
| 2387055 | 12/1978 | France . | |
| 1048309 | 11/1966 | United Kingdom . | |

*Primary Examiner*—Sherman D. Basinger
*Assistant Examiner*—Thomas J. Brahan
*Attorney, Agent, or Firm*—Wells, St. John & Roberts

[57] ABSTRACT

A swim fin includes a shoe assembly for attachment to the individual feet of the user, an outwardly projecting rigid support frame, a pivoted web, and a strap or band for yieldably limiting the extent of pivotal movement of the web relative to the supporting frame about a transverse pivotal axis. The web has a plan configuration that includes a substantially straight transverse trailing edge and a leading edge in the shape of a swept-back ellipse. Longitudinal sections across the web have proportional sectional configurations and a constant maximum thickness to length ratio between the upper and lower web surfaces.

14 Claims, 3 Drawing Sheets

10
11
12
13
14
15
16
17
18
32

FIG 5
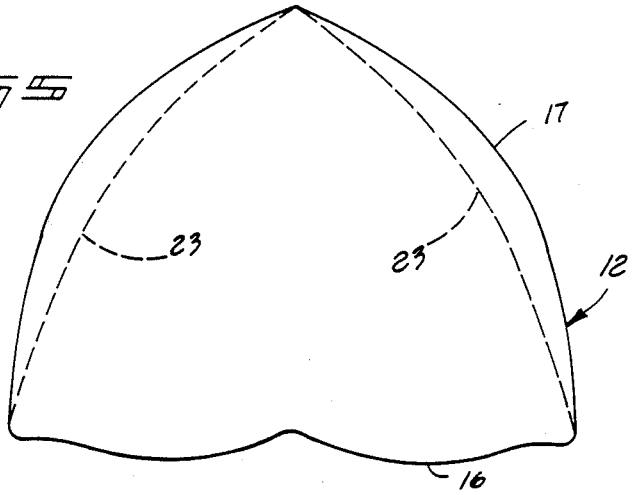
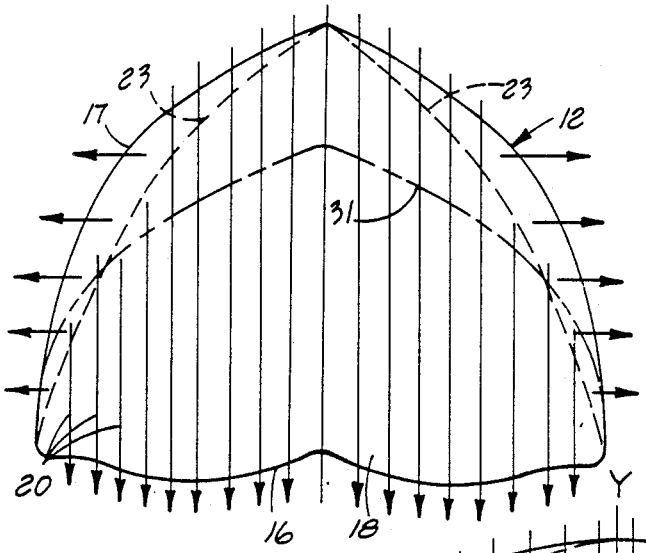
FIG 6
FIG 7
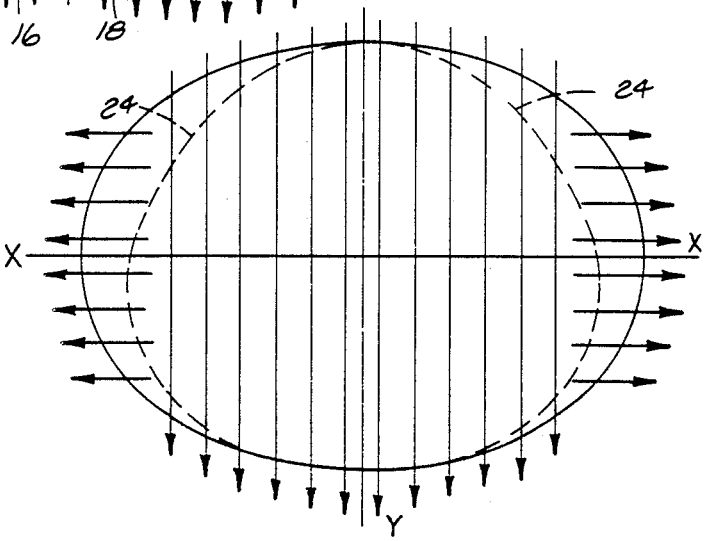

SWIM FIN

TECHNICAL FIELD

This disclosure relates to swim fins used for swimming underwater or at the surface.

BACKGROUND OF THE INVENTION

U S. Pat. No. 3,665,535, issued May 30, 1972, discloses a swim fin assembly including webs pivotally mounted on rigid frames extended forwardly from the feet of a user. The webs are pivoted intermediate their longitudinal ends. The extent of pivotal movement available to the webs in response to kicking action of the user is mechanically limited by interconnections between the supporting frames and the webs. The disclosure of U.S. Pat. No. 3,665,535 is hereby incorporated into the present disclosure by reference.

The present invention arose from continuing efforts to improve the efficiency and operation of the swim fin disclosed in U.S. Pat. No. 3,665,535. It continues to simulate the swimming action of sea mammals, but further incorporates a novel aerodynamic web shape that reduces turbulence created by the swim fin and improves its performance substantially.

According to the details of the web embodiment disclosed and shown in the accompanying drawings, the web is formed as a rigid member having a substantially transverse trailing edge intersecting a rearwardly curved leading edge that is generated as a swept-back ellipse. The desired elliptical curvature is maintained across the full width of the web, which has proportional longitudinal sections across its width having a constant maximum thickness to length ratio. This web produces the most forward thrust with the least amount of kicking effort.

BRIEF DESCRIPTION OF THE DRAWINGS

The preferred embodiment of the invention is illustrated in the accompanying drawings, in which.

DETAILED DESCRIPTION OF THE PREFERRED EMBODIMENT

The following disclosure of the invention is submitted in compliance with the constitutional purpose of the Patent Laws "to promote the progress of science and useful arts" (Article 1, Section 8).

As used in this description, references to 37 longitudinal"shall refer to surfaces and directions parallel to the direction of movement of a swimmer using the swim fin. References to "transverse" shall refer to surfaces and directions that are substantially horizontal during use of the swim fin and perpendicular to the longitudinal surfaces and directions.

In U.S. Pat. No. 3,665,535, there is disclosed an improved swim fin structure that includes means for attachment to the individual feet of a swimmer, a support frame extending longitudinally outward from the attachment means, a rigid web structure pivotally connected to the support frame, and means for limiting the extent of pivotal movement of the web structure relative to the support frame. This provides a swim fin which can be readily used by any swimmer to increase forward kicking thrust in water.

The present disclosure describes an improved shape and form for the web used in the previously-disclosed swim fin. It maximizes forward thrust while minimizing the required kicking effort. It is based upon recognized aerodynamic theory which teaches that the most efficient shape for a wing is an elliptical curve with a constant thickness to length ratio at any section.

An elliptical shape is most efficient in the design of a wing because such a wing, as it moves through a fluid (air or water) and produces lift, will cause most of the fluid to move directly from its leading edge to its trailing edge, although a portion of it will be forced to the side. This sideward flow creates fluid vortices and resulting induced drag. The smaller the induced drag, the greater the wing efficiency. It is known that a wing having a conventional elliptical shape has a smaller ratio of sideward flow to longitudinal flow than any other wing shape.

Figures 1, 2, 3, 4, 5, 6, 7, 8:
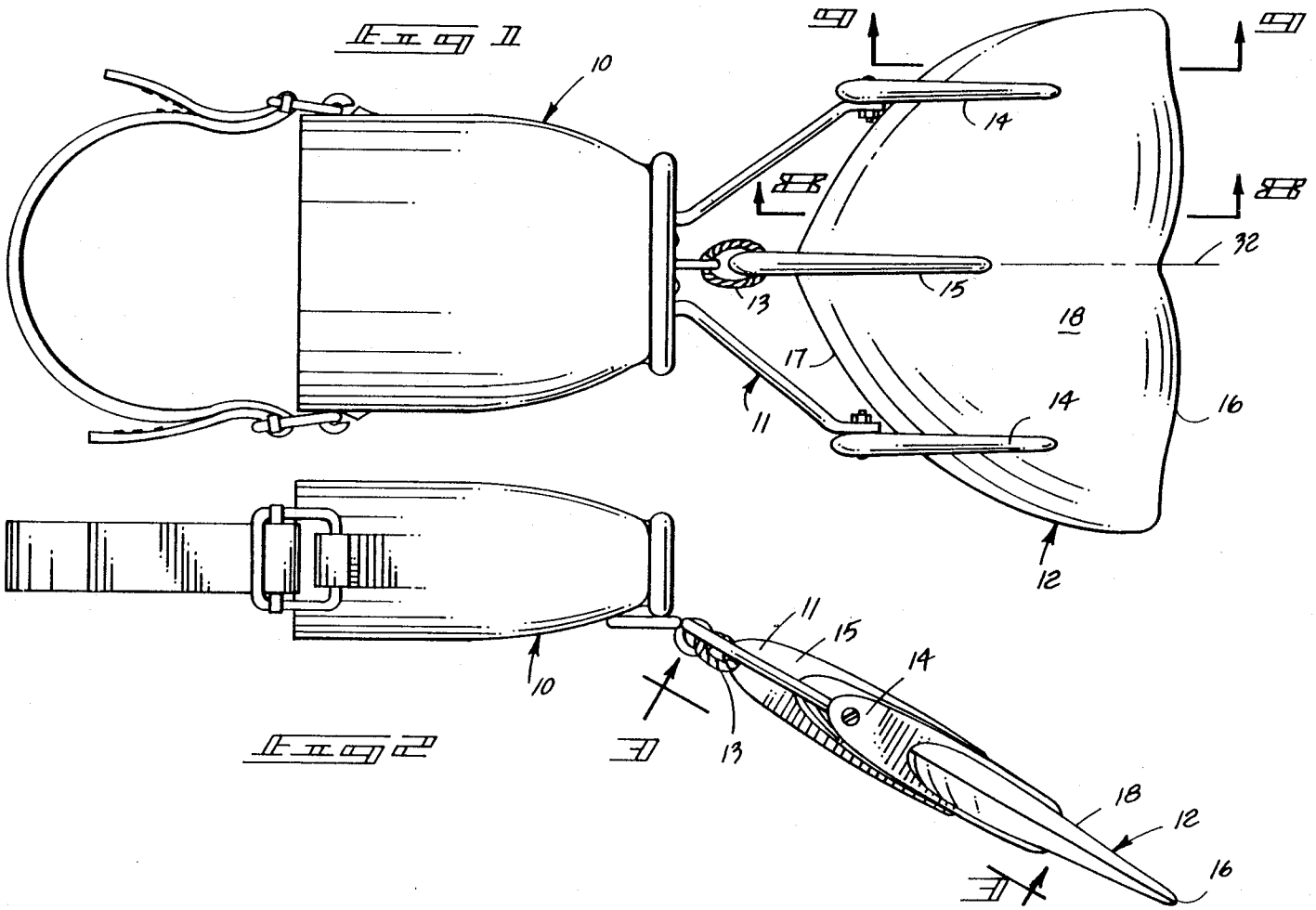
FIG. 1 is a top view of the swim fin.
FIG. 2 is a side view.
FIG. 3 is a bottom view of the web, as seen along line 3—3 in FIG. 2.
FIG. 4 is a diagrammatic view showing the development of the swept-back web shape.
FIG. 5 is a diagrammatic view showing the actual outline and effective shape of the swept-back web.
FIG. 6 is a diagrammatic view illustrating the longitudinal movement of water along the moving web.
FIG. 7 is a view similar to FIG. 5, illustrating water movement over an elliptical web.
FIG. 8 is a diagrammatic view illustrating angular pivotal movement of the web.
Figure 3:
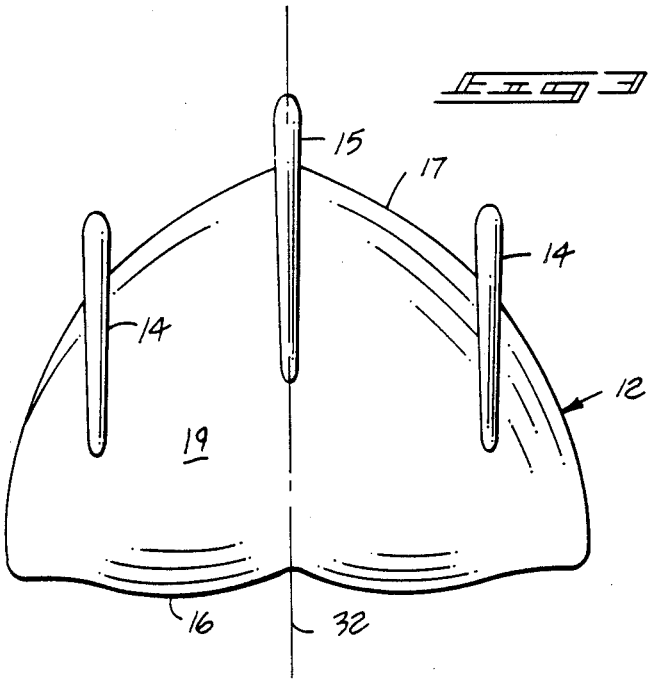
Figure 4:
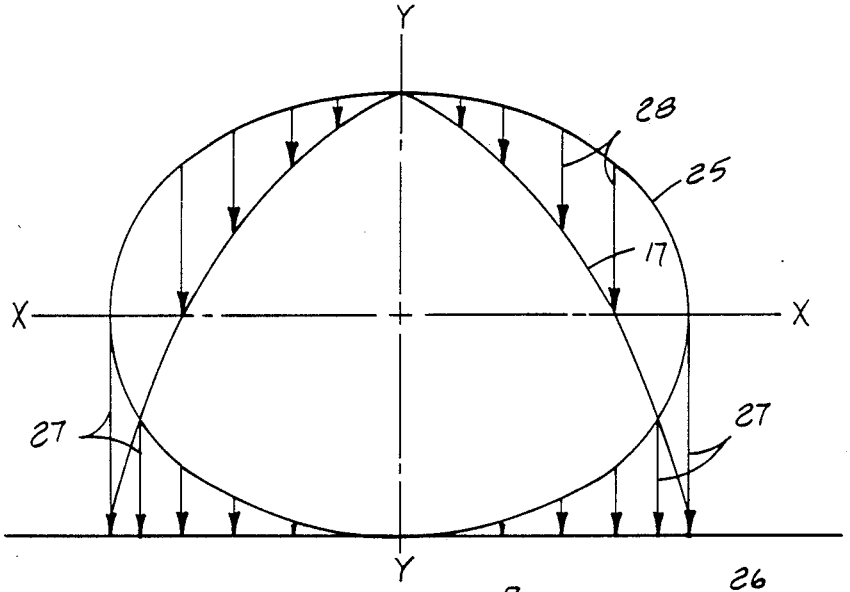
Figure 8:
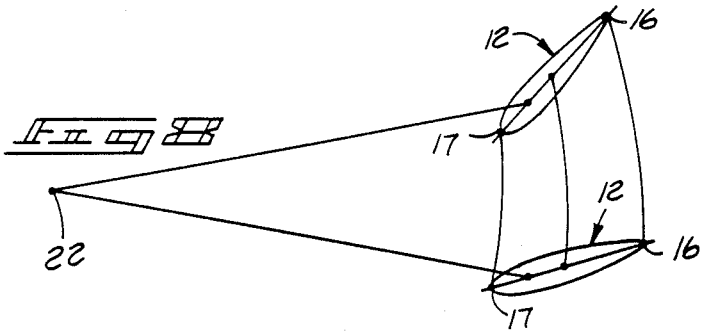

Applying this aerodynamic theory to the pivoting web of my previously-disclosed swim fin has resulted in the improved web shape and structure illustrated in FIGS. 1–3, 5 and 9–12. FIGS. 4 and 5 diagrammatically illustrate the geometric development of the web. FIGS. 6–8 diagrammatically illustrate the effective operation of the web.

As generally shown in Figs. 1 and 2, the swim fin comprises shoe means for attachment to one foot of a swimmer, illustrated as a pocket and strap combination shoe 10, which would be typically fabricated from molded rubber components. The specific shape and type of shoe used to attach the swim fins to the individual feet of a user are not critical to this disclosure. Other forms of shoes and attachment structures can be substituted for that illustrated in the drawings. The toe section of the shoe 10 is substantially rigid and supports a frame 11 that is fixed to the shoe 10 and extends longitudinally outward from it. Frame 11 is rigid and would typically be fabricated from metal. The outer portions of frame 11 pivotally support a web 12 about a transverse axis. The pivot axis for web 12 is longitudinally positioned between its front and rear extremities.

Web 12 includes a pair of side longitudinal ribs 14 and a center rib 15 which serve as mechanical attachments to the supporting frame members. Ribs 14 and 15 are preferably streamlined and arranged longitudinally to further facilitate longitudinal fluid flow along web 12 without creating any lateral fluid disturbances.

Web 12 is preferably molded from a rigid rubber or plastic resin material having surface characteristics capable of withstanding normal abrasion and contact with structures and surfaces that might be engaged by the fin during its use and storage. It is substantially rigid to minimize efficiency loss that would result from flexing of web 12, and to maximize the pushing forces exerted on the user as the web is moved upwardly and downwardly in response to the usual kicking movements of a swimmer.

The swim fin is completed by a resilient strap or band 13 operatively connected between frame 11 and web 12 for limiting pivotal movement of web 12 relative to the frame 11 about the transverse pivotal axis.

The use and operation of the swim fin involves strapping the foot of a user within shoe 10, and kicking in the normal fashion for underwater or surface swimming purposes. As the user moves the swim fin up and down, web 12 pivots in response to forces exerted on it by the water in contact with web 12, creating rearwardly directed forces that help to propel the user. Further details concerning the general operation of the swim fin can be understood from the drawings and description in U.S. Pat. No. 3,665,535.

The web 12 has an upper surface 18 and a lower surface 19 which are each transversely symmetrical across a longitudinal plane represented by line 32 in FIGS. 1 and 3. As described below, it is also elevationally symmetrical in cross-section across a central transverse plane, whether viewed longitudinally (toward its ends) or transversely (from its sides). It has a transversely extended trailing edge 16 that faces oppositely to the shoe 10. It has a rearwardly-curved convex leading edge 17 facing toward the shoe 10. The leading edge 17 intersects opposite ends of the trailing edge 16, the intersection of edges 16 and 17 being the widest transverse section across web 12.

As shown in FIGS. 1 and 3, the curvature of the leading edge 17 of web 12 is progressively increased in radius from the central longitudinal plane represented by line 32. The maximum radius of curvature is present at the intersections of the trailing edge 16 and leading edge 17 at opposite sides of web 12.

The shape of web 12 is generated by a geometric process that is diagrammatically illustrated in FIG. 4. Line 25 is a standard ellipse generated about major and minor axes X-X and Y-Y. The trailing edge 16 of web 12 is illustrated by line 26, which is tangent to the ellipse and perpendicular to its minor axis Y-Y. The leading edge 17 of web 12 is generated by longitudinally displacing ellipse 25 to merge its lower half along the transverse line 26 (as shown by arrows 27), which in turn displaces its upper half (as shown by arrows 28). In short, the leading edge 17 has a transverse shape generated by longitudinally displacing an ellipse rearwardly to a transverse line drawn tangentially to the standard ellipse, the maximum width of web 12 being at the intersection of its leading and trailing edges 17 and 16. The length of the web 12 from the leading edge 17 to the trailing edge 16 varies as an ellipse, but is displaced backward to the point where the maximum width of web 12 is at its trailing edge 16. The actual curvature of leading edge 17 shown in the drawings varies slightly from that shown geometrically in FIG. 4 because the trailing edge 16 is fluted to simulate typical flukes across the tail of a marine mammal. While the trailing edge 16 shown in the drawings is substantially transverse and straight, the deviations in displaced length of the web between the leading edge 17 and trailing edge 16 result in a slightly pointed central section at the front of web 12.

The design of web 12 is a modified ellipse, which results in an effective shape or area about surfaces 18 and 19 which is greater in size than is available in a conventional elliptical web, which is recognized to have a minimum ratio of sideward fluid flow to longitudinal flow. FIG. 6 shows an outline of the trailing edge 16 and leading edge 17 in web 12, with longitudinal lines 20 representing longitudinal fluid flow over or under the web 12 and transverse lines 21 representing sideward fluid flow at the side edges of a theoretical web having the shape of a standard ellipse. For purposes of this disclosure, a standard ellipse (FIG. 7) is a closed curve of oval shape constructed along a major axis X-X and a smaller perpendicular minor axis Y-Y and defined by the equation:

$$y = \sqrt{b^2\left(1 - \frac{x^2}{a^2}\right)}$$

where x and y are coordinates along the major and minor axes, respectively, b is the distance between the intersection of the major and minor axes and the intersection of the ellipse along the minor axis Y-Y, and a is the distance between the intersection of the major and minor axes and the intersection of the ellipse along the major axis X-X.

As seen in FIG. 8, a swimmer using the swim fin will kick the web 12 up and down through an arc about a pivot point 22 at the hip joint, knee joint, ankle joint, or a combination of these three bodily joints. Because of this, the leading edge 17 of web 12 does not move as far and as fast up and down as does the trailing edge 16. Therefore, the velocity of trailing edge 16 exceeds the velocity of leading edge 17, and intermediate points between these edges will move at intermediate velocities. Since any wing or fin can produce lift only if fluid (air or water) is moving over it, if the velocity of any point on the web 12 is zero, the effective lift or force at that point will also be zero. Similarly, the surface area of a wing or a fin is only effective when subjected to fluid velocity. The effective area or shape of a fin that moves up and down through an arc as shown in FIG. 8 can be determined by multiplying the actual width of the fin at any point by the up and down velocity at that point and dividing the result by the maximum velocity at the trailing edge 16. The effective shape of the swept-back ellipse included in web 12 is shown in FIGS. 5 and 6 by dashed lines 23. Similarly, the effective shape of a standard ellipse is shown by dashed lines 24 in FIG. 7. Note that the effective shape of the standard ellipse is not as wide as its actual shape, while the effective shape of the swept-back ellipse (FIG. 6) does merge with its actual width and covers a greater percentage of the illustrated web area.

Note in FIG. 6 that the maximum width of the effective shape (outlined by lines 23) equals the maximum width of the actual shape of web 12. The reason for this is that the maximum width of the effective shape occurs at the points of maximum fluid velocity of the trailing edge 16. Therefore, for any given ellipse, a swept-back ellipse having the same length and width dimensions will have a wider effective shape when moved through an arc as in FIG. 8. According to aerodynamic theory and experiments, the wider a wing is in comparison to its total area, the less induced drag will result during its use. This is because there will be more longitudinal fluid flow over the wing than sidewards flow. In addition, because the swept-back ellipse shape of web 12 is an ellipse, it will have a higher efficiency than any non-elliptical swept-back web or fin of the same width and area.

Figure 9:
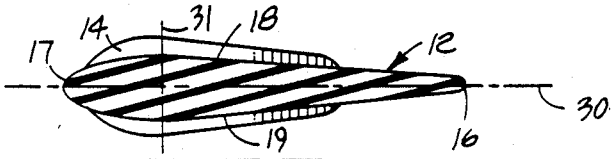
FIG. 9 is a longitudinal section as seen along line 8—8 in FIG. 1.
Figure 10:
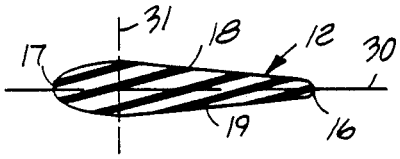
FIG. 10 is a longitudinal section of the web as seen along line 9—9 in FIG. 1.

In addition to the swept-back elliptical shape of the web 12 when viewed from the top or bottom, the web 12 has proportional longitudinal sections across its width having a constant shape and a constant maximum thickness to length ratio. This is illustrated by the two typical longitudinal sections shown in FIGS. 9 and 10. Referring to FIGS. 9 and 10, lines 30 illustrate a projection of a central transverse plane containing its leading edge 17 and trailing edge 16. Perpendicular lines 31 intersect the points of maximum thickness through web 12 at the respective longitudinal sections. The curved plane of maximum thickness of web 12 is shown in FIG. 6 by line 31. It is shown as being located at 25% of the total section length.

Figure 11:
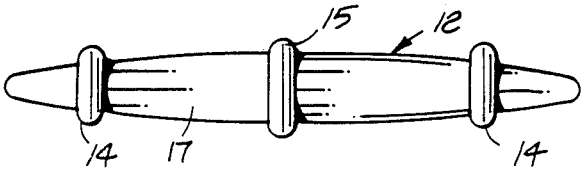
FIG. 11 is a front view of the web.
Figure 12:
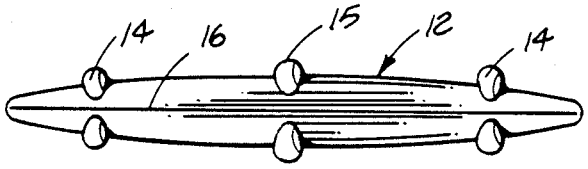
FIG. 12 is a rear view of the web.

As seen in FIGS. 9 and 10, every longitudinal section through web 12 includes a forward portion having the curvature of a standard ellipse with a major axis coincident with line 30. A rear portion of the longitudinal sections has the configuration of two straight lines that are tangential extensions of the ellipse of the forward portion and that intersect one another at the trailing edge 16. The web 12 is symmetrical in shape across the central transverse plane represented by line 30, as can be seen in FIGS. 9–11. Also, as shown in FIGS. 8 and 9, the trailing edge 16 of web 12 is coplanar with the major axis of the ellipse of the forward portion of the longitudinal section.

Experimental testing by underwater swimmers or scuba divers comparing the present fin to conventional molded fins worn on the feet of divers have shown that the present fin increases swimming speed, reduces oxygen consumption when used in underwater swimming, and reduces the exertion of the swimmers.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. A swim fin comprising:

shoe means for attachment to one foot of a swimmer;

a frame fixed to the shoe means and extending longitudinally outward therefrom;

a rigid web pivotally connected to the frame about a transverse axis, the web being transversely symmetrical across a central longitudinal plane and having a transversely extended trailing edge facing oppositely to the shoe means and intersected at opposite ends by a rearwardly-curved convex leading edge facing toward the shoe means, the curvature of the leading edge of the web being progressively increased in radius from the central longitudinal plane to a maximum radius at the intersections of the trailing and leading edges of the web;

and means operatively connected between the frame and web for limiting pivotal movement of the web relative to the frame about the transverse axis.

2. The swim fin of claim 1 wherein the web has proportional longitudinal sections across its width having a constant shape and a constant maximum thickness to length ratio.

3. The swim fin of claim 1 wherein the web has proportional longitudinal sections across its width having a constant shape and a constant maximum thickness to length ratio;

the web also being symmetrical in shape across a central transverse plane containing its trailing and leading edges.

4. The swim fin of claim 1 wherein the trailing edge of the web, when viewed toward its rear longitudinal end, is a straight line.

5. A swim fin comprising:

shoe means for attachment to one foot of a swimmer;

a frame fixed to the shoe means and extending longitudinally outward therefrom;

a rigid web pivotally connected to the frame about a transverse axis, the web being transversely symmetrical across a central longitudinal plane and having a transversely extended trailing edge facing oppositely to the shoe means and intersected at opposite ends by a rearwardly-curved leading edge facing toward the shoe means, the leading edge of the web having the transverse shape generated by rearwardly displacing an ellipse toward the trailing edge of the web;

and means operatively connected between the frame and web for limiting pivotal movement of the web relative to the frame about the transverse axis.

6. The swim fin of claim 5 wherein the web has proportional longitudinal sections across its width having a constant shape and a constant maximum thickness to length ratio.

7. The swim fin of claim 5 wherein the web has proportional longitudinal sections across its width having a constant shape and a constant maximum thickness to length ratio;

the web being symmetrical in shape across a central transverse plane containing its trailing and leading edges.

8. The swim fin of claim 5 wherein the Web has proportional longitudinal sections across its width having a constant shape and a constant maximum thickness to length ratio;

the web, when viewed toward either of its longitudinal ends, having a transverse elevational outline in the form of an ellipse.

9. The swim fin of claim 5 wherein the trailing edge of the web, when viewed toward its rear longitudinal end, is a straight line.

10. A swim fin comprising:

shoe means for attachment to one foot of a swimmer;

a frame fixed to the shoe means and extending longitudinally outward therefrom;

a rigid web pivotally connected to the frame about a transverse axis, the web being transversely symmetrical across a central longitudinal plane and having a swept back elliptical shape across oppositely facing upper and lower surfaces that extend between a leading edge of the web facing toward the shoe means and a trailing edge of the web facing outwardly from the shoe means, the leading edge having a transverse shape generated by longitudinally displacing an ellipse rearwardly to a transverse line drawn tangentially to the ellipse, the maximum width of the web being at the intersection of its leading and trailing edges;

the web having proportional longitudinal sections across its width having a constant shape and a constant maximum thickness to length ratio between its upper and lower surfaces;

and means operatively connected between the frame and web for limiting pivotal movement of the web relative to the frame about the transverse axis.

11. The swim fin of claim 10 wherein the outline of the upper and lower surfaces of the web, when viewed toward either of its longitudinal ends, is in the form of an ellipse.

12. The swim fin of claim 10 wherein the trailing edge of the web, when viewed toward its rear longitudinal end, is a straight line.

13. The swim fin of claim 10 wherein every longitudinal section through the web is elevationally symmetrical across a central transverse plane containing its trailing and leading edges.

14. The swim fin of claim 10 wherein every longitudinal section through the web includes a forward portion having the curvature of an ellipse formed about a major axis coincident with a central transverse plane intersecting the leading edge of the web and a rear portion having the configuration of two straight lines that are tangential extensions of the ellipse of the forward portion and that intersect one another at the trailing edge of the web, the trailing edge being coplanar with the major axis of the ellipse of the forward portion

* * * * *